United States Patent [19]

Lieder et al.

[11] 3,936,043

[45] Feb. 3, 1976

[54] FLAP PULL DOWN CASE STRIPPING APPARATUS

[75] Inventors: Gaylerd Lieder, Minneapolis; Philip G. Rawlins, St. Paul, both of Minn.

[73] Assignee: Bemis Company, Inc., Minneapolis, Minn.

[22] Filed: July 26, 1974

[21] Appl. No.: 492,223

[52] U.S. Cl. ..... 271/14; 271/106

[51] Int. Cl.[2] ..... B65H 3/26

[58] Field of Search ..... 271/11, 12, 13, 14, 91, 271/105, 106, 131, 132, 134, 135, 136, 138, 139, 141, 142, 143, 144; 214/8.5 B, 8.5 F

[56] References Cited

UNITED STATES PATENTS

| | | | |
|---|---|---|---|
| 1,665,937 | 4/1928 | Smith | 271/91 |
| 2,336,499 | 12/1943 | Murch et al. | 271/14 |
| 2,727,740 | 12/1955 | Johnson | 271/12 |
| 3,008,384 | 11/1961 | Pierce, Jr. | 271/11 |
| 3,627,309 | 12/1971 | Ganz | 271/12 |

FOREIGN PATENTS OR APPLICATIONS

| | | | |
|---|---|---|---|
| 691,257 | 10/1930 | France | 271/105 |

*Primary Examiner*—Evon C. Blunk
*Assistant Examiner*—Robert Saifer
*Attorney, Agent, or Firm*—Dugger, Johnson & Westman

[57] ABSTRACT

A case magazine and case stripper part of a case opening, loader sealer machine, including longitudinal case slide rails for supporting a vertical stack of unopened, horizontal, flat folded cases, lug devices mounted on a carriage that is longitudinally reciprocated by an endless chain drive to remove the lowermost case from the stack and push the lowermost case forwardly along the slide rails as the carriage moves forwardly, vertical stack support magazine brackets locates adjacent the corners of the stack extending upwardly from adjacent the elevation of the slide rails, and being mounted to be selectively adjustably positioned longitudinally and transverse relative one another, vacuum cup assemblies on opposite transverse sides of the slide rails for pivoting transversely opposite lowermost flaps about fold lines to a given angle of inclination and then release the flaps, spring hold down mechanism for retaining the flaps at said angle while permitting the flaps to be translated forwardly and control mechanism for the vacuum cup assemblies. The carriage mounts the gripper lug devices for engaging the inclined flaps and moving the lowermost case forwardly of the magazine brackets while the flaps are being retained at said angle.

18 Claims, 7 Drawing Figures

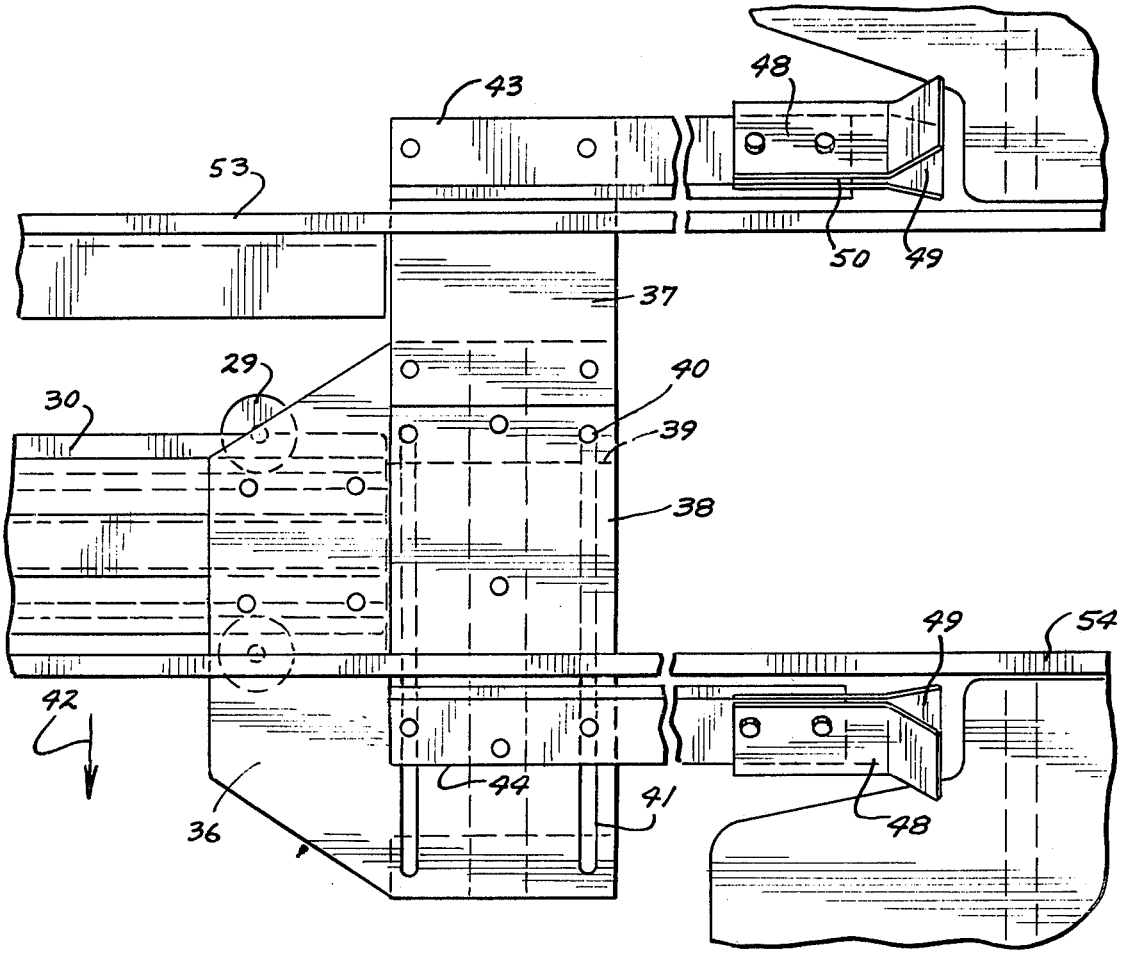
FIG. 3
FIG. 4
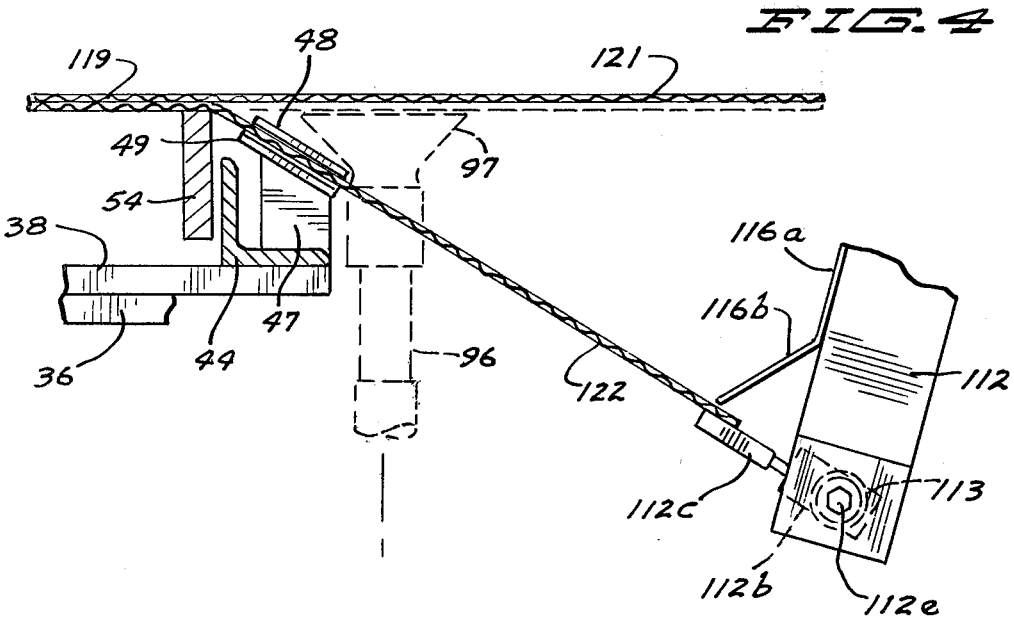

FLAP PULL DOWN CASE STRIPPING APPARATUS

BACKGROUND OF THE INVENTION

Case magazine and stripping mechanism for supporting a vertical stack of unopened, horizontal, flat folded cases, and removing the lowermost case, one at a time, from the bottom of the stack and conveying the case forwardly to a location to have another work operation performed thereon.

In the prior art it is old to provide case stripper mechanism that removes one case at a time from the bottom of a vertical stack of horizontally flat folded cases in a case magazine while the case body and flaps all are in a horizontal condition. However, with such prior art mechanism problems have been encountered in handling wrapped cases, and in handling square cases, special corner cutting has been required. In order to avoid or overcome problems such as the above, as well as provide other advantages, this invention has been made.

SUMMARY OF THE INVENTION

Case magazine and case stripper structure that includes horizontal slide rails, a case magazine retaining a stack of flat folded, horizontal cases in generally vertical alignment on the slide rails, case stripper mechanism for moving one case at a time from beneath the stack and along the slide rails, and flap pull down and retainer mechanism for pivoting transversely opposed lowermost flaps to given angles of inclination and retain the flaps at said angles to be subsequently engaged by the stripper mechanism for removing the lowermost case from the magazine.

One of the objects of this invention is to provide on a machine having a case magazine for retaining cases in a flat folded horizontal condition in vertical stacked relationship, new and novel mechanism for first moving opposed lowermost flaps of a case to extend downwardly and then retain said flaps in said condition as the case is stripped from the magazine. Another object of this invention is to provide new and novel spring retainer mechanism permitting transversely opposed case flaps being pivoted to given angles of inclination and retaining said flaps at said angles as the case is translated longitudinally forwardly. In furtherance of the last mentioned object, it is another object of this invention to provide new and novel flap pull down mechanism for moving said flaps to said given angles of inclination. An additional object of this invention is to provide new and novel case stripping mechanism for positively engaging case flaps including extending above and beneath portions of the flaps for moving the lowermost case in a vertical stack of cases forwardly of the magazine for said stack.

BRIEF DESCRIPTION OF THE DRAWINGS

FIG. 1 is a fragmentary side rear view of the bag magazine and case stripping portion of a case opening, loader-sealer machine, including the mechanism for moving the bottom case forwardly from a vertical stack of unopened, horizontal, flat folded cases, various parts being broken away so as to more clearly show other parts of the structure of said portion and one vacuum control rod being shown in its datum position in solid lines and in its second position in dotted lines;

FIG. 3 is an enlarged fragmentary plan view of the carriage and structure mounted thereon with the carriage in its forwardmost position;

FIG. 4 is an enlarged fragmentary transverse sectional view looking rearwardly to illustrate one of the lowermost case flaps being retained at a given angle of inclination by a spring hold down assembly and engaged by the gripper lug mechanism for pushing the case forwardly, the uppermost elevated position of a vacuum cup being illustrated in dotted lines;

Figure 2:
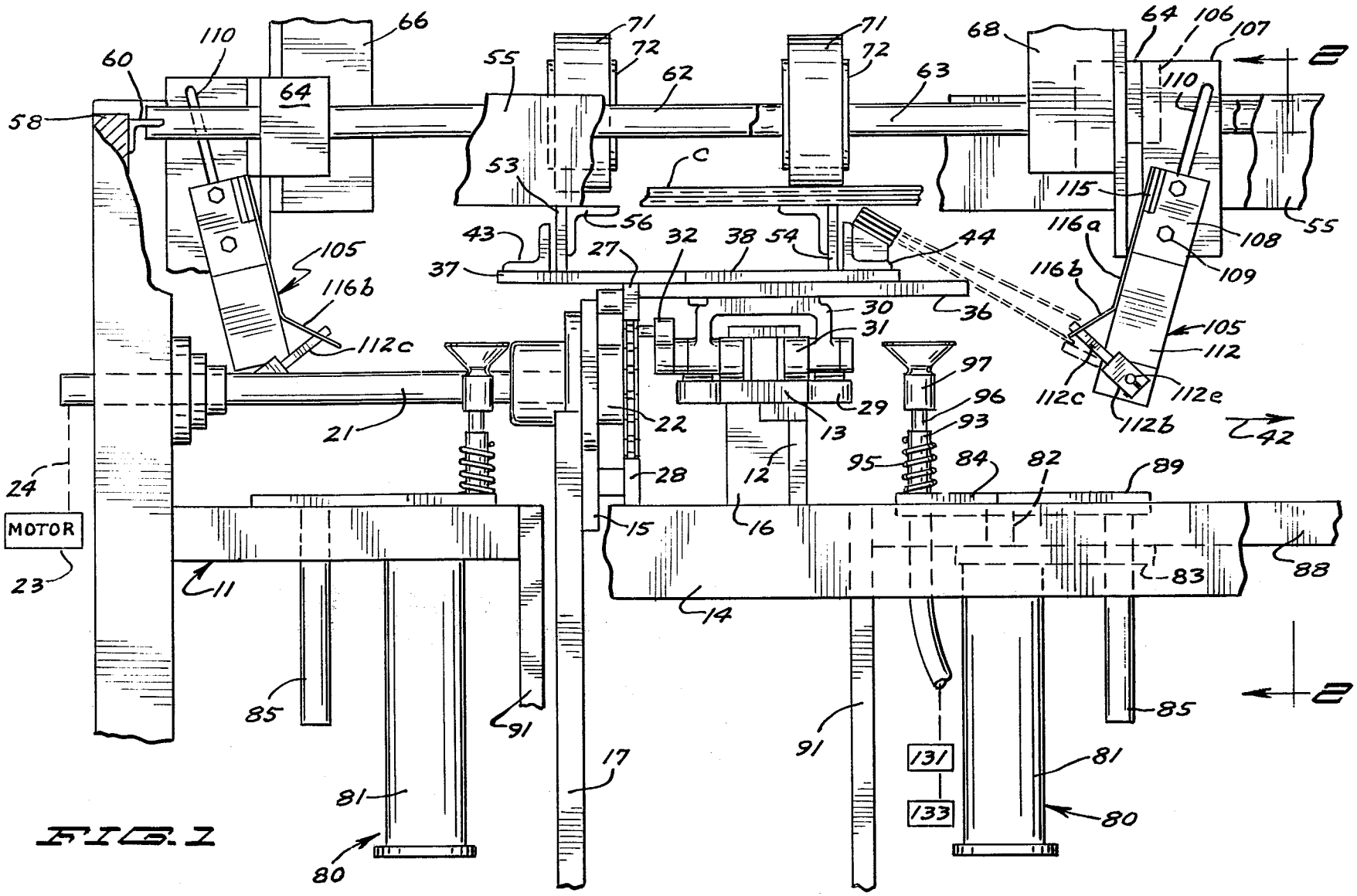
FIG. 2 is a fragmentary side view generally taken along the line and in the direction of the arrows 2—2 of FIG. 5 with a longitudinally intermediate portion broken away, said view showing the carriage in its rearward position.

The case opening, loader-sealer machine includes a frame, generally designated 11, that mounts an upstanding bracket 12 on a rear transverse frame member 14. A generally I-shaped track 13 that is longitudinally elongated is in part mounted by the bracket 12 and in part by a mounting bracket 16 that is mounted on a front transverse frame member (not shown). On one transverse side of the track 13, there is provided a longitudinally elongated, vertical drive plate 15 which is mounted by frame members 17. The drive plate rotatably mounts an idler sprocket (not shown) with the sprocket being transversely between the drive plate and the track. A substantial distance longitudinally rearwardly of the idler sprocket, the drive plate rotatably mounts a shaft 21 which has a drive sprocket 22 keyed thereto to be located between the drive plate and the track. A drive connection 24 is provided from a motor 23 to shaft 21 for driving the shaft 21. A chain 26 is extended around the idler sprocket and the drive sprocket, the drive plate mounting an upper chain track 27 and a lower chain track 28 to aid in retaining the upper and lower runs of the chain in generally horizontal condition.

A carriage 30 is mounted on the track 13 for longitudinal reciprocal movement, the carriage having rollers 29 and 31 mounted for rotation about vertical and horizontal axes respectively for retaining the carriage on the track. On one side of the carriage, a control link 32 has one end pivotally connected thereto by a pivot 33 while the opposite end of the control link is pivotally connected to a link of the chain 26 by a pivot member 34. As a result, with the upper run of the chain moving in the direction of the arrow 35 and the link to which the pivot member 34 is attached is along the upper run, the carriage is moved in the direction of the arrow 35. However, when the chain link to which the pivot member 34 is connected is part of the lower run of the chain, the carriage is moved in the direction opposite the arrow 35.

A base plate 36 is bolted to the carriage at a higher elevation than the drive plate 15 to extend forwardly of the carriage. At one transverse side of the base plate there is bolted a first mounting plate 37 to extend transversely outwardly thereof. An adjustable mounting plate 38 has bolts 40 extended through circular apertures of the edge portion adjacent plate 37, through transversely elongated apertures 41 provided in the base plate, and through circular apertures in a retainer plate 39 that is located on the opposite side of the base plate from the mounting plate. By loosening the nuts on the bolts 40, the plate 38 may be moved in the direction of the arrow 42 to increase the spacing between plates 37, 38 shown in FIG. 3, and then the nuts tightened for retaining plate 38 in a transversely adjusted position. The transversely remote edge portions of plates 37 and 38 respectively mount angle irons 43 and 44 to extend forwardly thereof. The forward end portion of each angle iron mounts a block 47, each block having top gripping lug 48, bottom gripping lug 49, and a spacer 50 bolted thereto with the spacer being located between the top and bottom gripping lugs and the bottom gripping lug being located between the spacer and the block 47. The top surfaces of the blocks 47 are planar and are inclined downwardly in transversely opposed directions at an angle of, for example, 30°. Each set of lugs initially extend forwardly of the spacers to have adjacent surfaces parallel to one another and thence diverge from one another in a forward direction, and inclined transversely at the same angle as the top surface of the adjacent block 47.

For supporting a plurality of unopened cases in vertical stacked, horizontal positions, there are provided a plurality of transversely spaced, longitudinally elongated case slide rails 53, 54 that at their one ends are secured to angle brackets 56 which in turn are dependingly mounted by rear transverse top frame member 55 and at their opposite ends by a frame member (not shown). The top edges of the case slide rails support the lowermost case in stack C at an elevation slightly above the uppermost part of gripper lugs 48. To be mentioned is that the slide rail 54 is mounted in a manner that the transverse spacing thereof from rail 53 may be adjusted.

The frame includes longitudinally elongated, parallel, top frame members 58 and 59 that are located transversely outwardly of the case slide rails and have their top portions located at a substantially higher elevation than said rails. Each of the frame members 58, 59 mounts a longitudinally elongated angle bracket 60. The transversely elongated rear magazine rail 62 has a slot at either end into which the horizontal leg of the adjacent angle bracket 60 extends whereby the rail is mounted by an angle bracket to be selectively adjustedly longitudinally positioned along the length thereof. Clamp bolts (not shown) are provided on the slotted end portions of the rail 62 for retaining the rail in selected longitudinally adjusted positions. Similarly, a front magazine rail 63 of the same construction as rail 62 is mounted by the angle brackets 60.

Figures 5, 6, 7, 8:
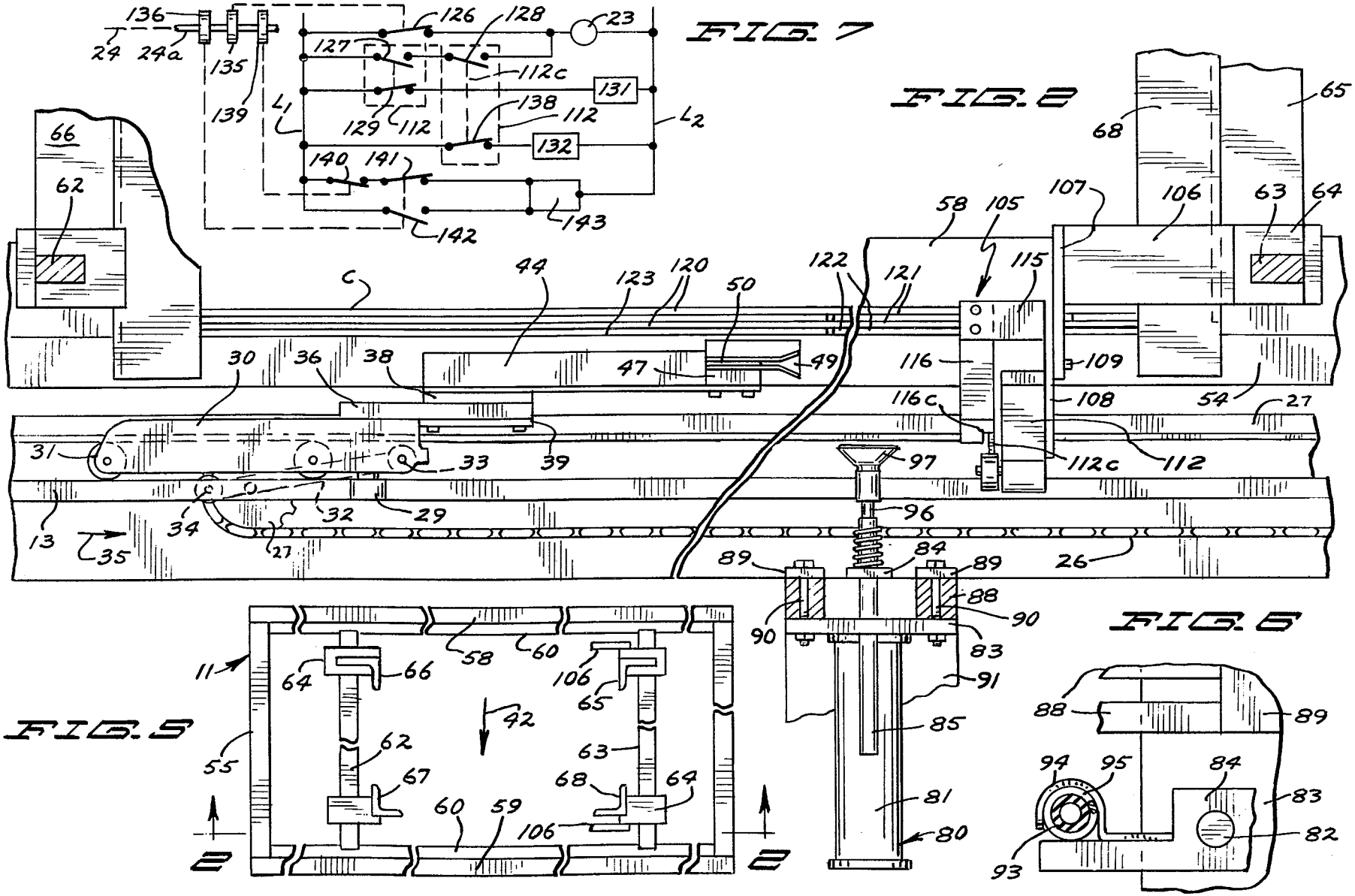
FIG. 5 is a somewhat diagrammatic showing of the magazine vertical support brackets and the mounting thereof, various portions being broken away.
FIG. 6 is a fragmentary plan view to more clearly illustrate the mounting of a vacuum hose by an elevating plate.
FIG. 7 is a simplified schematic showing of part of the controls of the machine.

In order to retain the cases in the vertical stack relationship, the magazine portion includes four angle brackets 65, 66, 67 and 68 respectively; each of which has a clamp member 64 secured to the lower end portion thereof (see FIG. 5). Angle brackets 65 and 66 are mounted on rail 63 and 62 respectively to have their transverse legs adjacent and facing one another while their longitudinal legs extend more remotely from one another than the transverse legs, brackets 65, 66 being adjacent frame member 58. The angle brackets 68 and 67 are mounted by their clamp members on the rails 63 and 62 respectively adjacent frame member 59 to have the transverse legs face one another and more remotely positioned from one another than the longitudinal legs. Through the provision of the clamp members, the transverse spacing of angle irons 67, 68 relative angle irons 65, 66 may be selectively varied and the clamp members tighten by conventional structure (not shown) for retaining the angle irons in their adjusted position. Further, due to the manner of mounting of the angle irons 65, 66, the cases in flat, folded condition may be moved inwardly therebetween in the direction of the arrow 42 while the longitudinally extending legs of angle irons 67, 68 limit the movement of the cases in the direction of the arrow 42. The angle irons 66, 67 extend to a lower elevation than the top edges of the case slide rails while the lower edges of at least the transverse legs of angle irons 65, 68 are located at an elevation that is at least the height of one case in flat, folded horizontal condition vertically above the top edges of the slide rails to permit the bottom case in the stack to be slid on the slide rails therebeneath. Preferably case lifter assemblies (not shown) such as fully described in copending application Ser. No. 422,308, filed Dec. 6, 1973, are mounted on the angle brackets 65–68 for elevating that part of the stack that is located vertically above the slide rails more than a preselected distance, and after the removal of a preselected number of cases from the magazine, automatically allowing the elevated part of the stack to bear against that part of the stack still supported by the slide rails, and thereafter elevate that part of the stack that is located more than a preselected distance above the slide rails.

Clamp members 72 are transversely adjustably positionable on the slide rails 63 and mount escape plates 71 at heights above the slide rails slightly greater than the thickness of one case in a flat, folded condition, but less than the thickness of two cases above said slide rails. For pulling the front flaps of the case on the slide rails to be inclined downwardly and transversely outwardly, there is provided a vacuum cup pull down assembly, generally designated 80, on transverse opposite sides of rails 53, 54. Each assembly 80 includes a two-way acting piston cylinder combination that includes a cylinder 81 bolted to a mounting plate 83 to depend thereform, and a piston rod 82 slidably extended through the mounting plate 83 and then secured to an elevating plate 84 for moving the elevating plate therewith. Secured to the elevating plate to move therewith is a depending guide rod 85 which is slidably extended through a suitable aperture in the mounting plate 83. On each longitudinal side of the piston rod there is provided a pair of longitudinally spaced, transversely elongated rails 88. Above each pair of rails 88 there is provided a retainer plate 89, nuts and bolts 90 being provided for securing each retainer plate to the vertically adjacent edge portion of the mounting plate 83 while permitting transverse adjustment of the mounting plate along the length of the rails 88. The inner ends of the rails 88 are mounted by a bracket 91 which in turn is mounted by the frame while the transverse outer ends of the rails are mounted by a frame member (not shown).

Referring in particular to FIGS. 1 and 6, the discharged end of the vacuum hose 93 has the coil spring 95 coiled tightly therearound, the lower end portion of the coil spring and the radially adjacent part of the hose being clamped by the clamp 94 to the elevating plate 84 to move therewith. Extended into the upper end portion of the vacuum hose is a steel tube 96 having a lower end that terminates a substantial distance above the elevating plate, the steel tube mounting a vacuum cup 97. As a result of the aforementioned mounting the steel tube usually extends substantially vertically, however the portion of the hose between the tube and the clamp in conjunction with the coil spring 95 permit sufficient flexing or bending of the hose so that the cup can perform the functions described hereinafter.

Referring to FIGS. 1, 2, and 4, a spring hold down assembly, generally designated 105 is mounted by each of the clamps 64 for angle irons 66 and 68. Each hold down assembly includes a longitudinally elongated bar 106 that is bolted to the respective clamp 64 to extend rearwardly thereof. The bars 106 are located on transversely remote sides of the clamps for angle brackets 66, 68. Further, each hold down assembly 105 includes a vertically elongated plate 107 that extends below and transversely outwardly of the respective bar 106. Each plate 107 includes an elongated slot 110 that is inclined downwardly and transversely inwardly to have bolts 109 extend therethrough for securing adjustment plate 108 to plate 107 in selected vertical and transversely adjusted positions. Plate 108 depends from plate 107 and mounts a switch 112, switch 112 including an operator shaft **112*e* that has a clamp block 112*b* secured thereto. Block 112*b* mounts an operating rod 112*c* to extend upwardly and transversely inwardly, the datum position of the operating rod being shown in its solid lines in FIG. 1. The shaft 112*e* is resiliently retained in a position that rod 112*c* is in its datum position by a conventional spring 113 of the switch 112. Also mounted by plate 108 to extend longitudinally rearwardly thereof is a spring mounting plate 115. The rear end portion of plate 115 mounts an elongated spring steel finger 116 to depend therefrom; finger 116 having an upper part 116*a* that is of a substantially greater length than the lower part 116*b*. The upper part 116*a* is inclined downwardly in a transversely inwardly direction while part 116*b* also extends downwardly and transversely inwardly at a smaller angle relative the horizontal than part 116*a*. The lower portion of part 116*b* is provided with a cut out that forms a horizontal edge 116*c* against which the rod 112*c* abuts when the rod is in its datum position. As may be noted from FIG. 2, the vacuum cups 97 are located longitudinally intermediate the spring fingers 116 and the gripper lugs 48, 49** when the carriage is in its rearwardmost datum position.

Referring to FIG. 7 there is a simplified showing of part of the control circuit of the machine wherein $L_1$ and $L_2$ are power lines having a normally closed flap down safety switch 126 and motor 23 connected in series thereacross. During a cycle of operation of the machine, switch 126 is moved to and retained in an open position for a short interval through a cam 135 on shaft **24*a* that forms part of the drive connection 24.**

Switches 112 respectively have first switch members 127 and 128 connected in series with one another across line $L_1$ and the connection between switch 126 and motor 23; and second switch members 129 and 138 respectively. Switch member 129 and the solenoid coil (not shown) of vacuum control valve 131 are connected in series across lines $L_1$ and $L_2$ as are switch member 138 and the solenoid coil (not shown) of vacuum control valve 132. The rod **112*c* of one switch 112 controls the switch member 129 and thereby the valve 131 that is in the vacuum line 93 for the vacuum cup on the same transverse side of the machine, the other switch 112 similarly controlling valve 132 in the other vacuum line 93. The positions of the switch members of switch 112 are controlled by rods 112*c*, switch members 127, 128 being open and switch members 129, 138 being closed when the rods are in their datum positions, and when the rods are in their second positions, members 127, 128 are closed and members 129, 138 are open. When switch member 129, 138** are open, no vacuum is applied through the vacuum cups, the vacuum being applied through the valves when the valves are energized.

A double solenoid coil four-way valve 143 has one coil (not shown) connected in series with a switch 142 and a second coil (not shown) connected in series with switches 140, 141. Switches 140, 141 and the second coil are connected in series across lines $L_1$ and $L_2$, and switch 142 and the one coil are also connected in series across said lines. When both switches 140, 141 are closed, the valve member (not shown) of valve 143 is moved to a position that fluid under pressure is applied to the lower end of the elevating cylinders and remains in this position until switch 142 is closed, while when switch 142 is closed, the valve member of valve 143 is moved and remains in a position fluid under pressure is applied to the upper ends of the elevating cylinders. Switch 140 is moved between opened and closed positions by a cam 139 on shaft **24*a*, while switches 141 and 142 are moved together between opened and closed positions by a cam 136 on shaft 24*a*. Switch 141 is closed when switch 142** is opened.

Before describing the use of this invention, it will be mentioned that each case C in its flat folded condition in a position to be fed from the magazine is considered to have a body 119 and flaps extending transversely outwardly from either side of the body that include upper major flaps 120, upper minor flaps 121 that are longitudinally forwardly of the major flaps 120, lower major flaps 122 and lower minor flaps 123 that are longitudinally rearwardly of flaps 122.

In using the apparatus of this invention, the transverse spacing of slide rail 54 from slide rail 53 is adjusted so that the slide rails bear against the body of the case just inwardly of and along the length of the junctures of the flaps to the body, and plate 38 is clamped in an adjusted position that the vertical leg of angle iron 44 is closely adjacent slide rail 54 but on the opposite side thereof from slide rail 53. The vertical leg of angle iron 43 is adjacent rail 53 and on the opposite side thereof from rail 54. Further, escape plates 71 are adjusted to be located vertically above the slide rails and spaced therefrom by an amount previously indicated. Additionally, the longitudinal spacing of transverse rails 62, 63 is adjusted, if necessary, so that the spacing of the transversely adjacent surfaces of the transverse legs of angle irons 65, 66 is slightly greater than the longitudinal length of the flat case in a horizontal condition. Further, the transverse positions of the angle brackets 65–68 is adjusted, if necessary, so that the longitudinal edges of the flaps will be closely adjacent or abutting against the transverse inward surfaces of the longitudinal legs of brackets 67, 68 and just transversely inwardly of the longitudinal legs of brackets 65, 66, and the flaps are in a position relative the slide rails such as previously indicated. Also plates 108 are adjusted relative plates 107 by first loosening the nuts on bolts 109 and thence tightening the bolts so that when the lowermost major flaps are extended downwardly at a substantial angle relative the plane of the body, for example 30°, the flaps will first bend spring finger portions **116*b* transversely outwardly and engage rods 112*c* to move the rods from the solid line datum position of FIG. 1 to the dotted line second position thereof in a manner to be described in greater detail hereinafter. In addition the transverse spacing of the vacuum cups is adjusted by loosening the nuts on bolts 90 and sliding the retainer plates 89** to the appropriate transverse positions and then tightening the nuts. The vacuum cups in the adjusted positions, when elevated, will engage the vertically adjacent, lowermost major flaps at locations transversely intermediate the slide rail and spring hold down assembly on the respective transverse side of the machine.

With the motor actuated and the carriage forwardly of the position illustrated in FIG. 1, but during the time it is being returned to the position in FIG. 1, the cam 139 moves switch 140 to a closed position for a short period of time to energize the one coil of valve 143 so that fluid under pressure is applied to the lower ends of cylinders 81 for elevating the vacuum cups to the dotted position of FIG. 4 wherein the vacuum cups abut against the lowermost major flaps, switch 141 being closed at this time. During the time the cups are being elevated switches 129, 138 are closed whereby vacuum is applied through hoses 85 so that upon the cups abutting against the flaps, the cups grippingly engage said flaps. Subsequent to the time the cups grippingly engaged the flaps, cam 136 operates switches 141, 142 so that the one coil of valve 143 is deenergized, if not already deenergized, and the other coil energized for a short interval whereupon fluid under pressure is applied to the upper end of the cylinders, which results in the major flaps 122 having their transverse outer edge portions swung downwardly, i.e. the major flaps bending down relative the body at the slide rails.

The transverse outer edge portions of flaps 122 in pivoting downwardly about fold lines of flaps 122 abut against the respective spring finger and bend the parts **116*b* transversely outwardly so that the flaps can move to a lower elevation than the lower terminal edges of parts 116*b*. Upon the flap outer edge portions clearing the lower terminal edges of the spring fingers, parts 116*b* return to the datum position of FIG. 4 to extend above the flaps 122 outer edge portions and prevent the flaps 122 pivoting upwardly a significant amount. During the time the flaps 122 are moving to a position to clear the lower edges of the spring fingers, the flaps abut against rods 112*c* to pivot the rods to the dotted line position illustrated in FIG. 1**, the rod and adjacent spring finger thence coacting to retain the respective flap at the given angle of inclination, but permitting the flap to be moved longitudinally forwardly.

Rods **112*c* in moving to the dotted line position operate switch members 129, 138 for discontinuing the application of the vacuum to the vacuum cups and accordingly the cups release their gripping engagement with flaps and thence are returned to their datum position. Thereafter the carriage in advancing (direction of arrow 35) moves the gripper lugs adjacent the rear transversely extending edges of the major flaps 122. As the carriage moves further forwardly, the upper lugs 48 move above the adjacent top surface of the major flap transverse rear edge portions and the lower lugs move below the adjacent bottom surfaces of the flaps and thence spacers 50 are moved into abutting engagement with the flaps rear edges. Thereafter, further forward movement of the carriage results in the major flaps of the lowermost case being moved forwardly of the spring fingers; and subsequently the lowermost case being moved forwardly from beneath the stack to other part of the machine (not shown) whereat folding and other operations are carried out on the case to form a box. Upon the lower major flaps being moved forwardly of rods 112*c*, the rods resiliently return to their datum positions whereupon switch members 127, 128 open and switch members 129, 138 close so vacuum is again applied to the suction cups 97. Upon the carriage being moved to its forwardmost position, the case is moved forwardly by other parts of the machine, which are conventional; the flaps 123 being horizontal and at an elevation to clear the carriage and the structure mounted thereon as the case is moved out of the magazine. After the lowermost case has been moved completely forwardly of the escape plates, the pivot member 34** is moved by a chain downwardly around the idler sprocket and thence rearwardly to retract the carriage and the structure mounted thereon. The cycle of operation continues as described heretofore.

To be mentioned is that the flap down safety switch is normally retained in a closed position, but it is momentarily operated by the motor drive (cam 135) to an open position during the initial increment of time that the rods **112*c* are supposed to be in their dotted line second position. In the event that one of the flaps 122 has not been pulled down, the switch member 127 or switch member 128 remains open (the respective one of rods 112*c* remaining in a datum position), and accordingly upon the flap down safety switch opening, the motor is deenergized to stop the machine. This safety feature is provided to prevent the case being moved forwardly without having both its major flaps 122 pulled down to positions for being engaged by the lugs 48, 49** as described heretofore.

Even though the case has been described as having major and minor flaps, it is to be understood that the machine of this invention can be used with square cases wherein the major and minor flaps are of the same lengths.

With this invention, the major flaps 122 being pivoted downwardly to extend outwardly at inclined angles from the remainder of the case, provide positive targets for the gripper lugs; and the lugs in both overlapping and underlapping the adjacent areas of the flaps 122 retain the flaps in positions to be pushed forwardly by the structure mounted on the carriage. Additionally, due to the lower, forward flaps being pushed forwardly while extending at angles diverging from the upper forward flaps, no special cuts have to be made in square cases such as usually required with prior art machines.

What is claimed is:

1. For removing a case having a body and flaps extending transversely outwardly from opposite sides of the body and joined thereto along fold lines from a vertical stack of cases in horizontal, flat folded conditions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slide from beneath the stack along the slide means, the bending and retaining means including operable gripper means on each transverse side of the slide means for grippingly engaging the adjacent flap, thence bending the adjacent flap to a preselected angle relative the body, and then release the adjacent flap, means mounted on the frame for retaining the adjacent flaps that have been bent to the preselected angles by the gripper means at the preselected angles while permitting the bent flaps to move longitudinally forwardly relative thereto, stripper means movably mounted on the frame for moving the lowermost case along the slide means from beneath the stack after the lowermost flaps have been bent downwardly, said stripper means including means for abuttingly engaging the lowermost case and moving the lowermost case forwardly along the slide means, and means for operating the gripper means to grip the adjacent flaps, bend the flaps and thence release the bent flaps after the flaps have been bent to the preselected angles, and moving the stripper means to move the abutting means into abutting engagement with the lowermost case in the stack to move it forwardly after the gripper means has released the bent flaps.

2. For removing a case having a body and flaps extending transversely outwardly from opposite sides of the body and joined thereto along fold lines from a vertical stack of cases in horizontal, flat folded conditions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slid from beneath the stack along the slide means, and stripper means mounted on the frame for moving the lowermost case along the slide means from beneath the stack after the lowermost flaps have been bent downwardly, said stripper means including a carriage mounted on the frame for longitudinal movement relative thereto and gripper means extendable in both under and overlapping relationship to the bent flaps transversely extending rear edge portions for pushing the lowermost case along the slide means, and means for mounting the gripper means on the carriage for movement therewith.

3. The apparatus of claim 2 further characterized in that the gripper means includes on each transverse side of the slide means, upper and lower gripper lugs and a spacer portion between the upper and lower lugs, said upper and lower lugs extending in spaced relationship a substantial distance longitudinally forwardly of the spacers, and on the respective side of said slide means, and being transversely inclined at said pre-selected angle, respectively, relative the horizontal.

4. The apparatus of claim 2 wherein the flaps for each case in the magazine includes on opposite sides of the body, lower minor flaps and lower major flaps longitudinally forwardly of the minor flaps, and the major flaps are bent to said preselected angles, further characterized in that the stripper means includes means on the frame for moving the carriage between a datum position at which the gripper means are located directly beneath the minor flaps and longitudinally rearwardly of the major flaps of a case in a flat, folded condition in the magazine, and a forward position a substantial distance longitudinally forwardly of the datum position.

5. For removing a case having a body and flaps extending transversely outwardly from opposite sides of the body and joined thereto along fold lines from a vertical stack of cases in horizontal, flat folded conditions wherein said flaps have transversely outwardly longitudinally extending terminal edge portions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slid from beneath the stack along the slide means, and stripper means mounted on the frame for moving the lowermost case along the slide means from beneath the stack after the lowermost flaps have been bent downwardly, said bending and retaining means including means on the frame for gripping transversely opposite flaps and moving said flaps to extend downwardly and transversely outwardly relative the slide means at a preselected angle on either transverse side thereof and thence releasing the transversely opposite flaps, and flap hold-down means on the frame for retaining the transversely opposite flaps at said angles after being moved thereto by the gripping means, and permitting the case to be moved from beneath the stack by the stripper means while said transversely opposite flaps are being retained at said angles, said flap hold-down means including on each transverse side of the slide means a vertically elongated spring finger having a lower edge and means for dependingly mounting the finger in a datum position in the path of downward movement of the transverse outer edge portion of the respective one of the transversely opposite flaps to be moved by the edge portion out of the path of movement until the edge portion is below said lower edge of the spring finger and then permit the spring finger to move to its datum position in overlapping relationship to the edge of the spring finger portion to hold the flap down.

6. The apparatus of claim 5 further characterized in that the hold-down means includes an elongated rod and means for mounting and resiliently retaining the rod in a datum position in abutting relationship to said lower edge while permitting the rod being moved to a second position where the transversely adjacent edge portion of the flap extends between the rod and lower edge when the respective one of the transversely opposite flaps is at said angle.

7. The apparatus of claim 6 further characterized in that said gripper means includes on each transverse side of the slide means, vacuum cup means for grippingly engaging the adjacent flap, and means mounted on the frame for moving the vacuum cup means between a datum lowered position and an elevated position where the cup means is engagable with the last mentioned flap when it is extending generally horizontally outwardly from the body.

8. The apparatus of claim 7 further characterized in that the gripper means includes a vacuum source and means, including an operable control valve, for connecting the vacuum source to the cup means.

9. The apparatus of claim 7 further characterized in that the stripper means includes a carriage, means on the carriage for moving the lowermost case from the bottom of the stack when the carriage is moving in one direction, and driven means for reciprocally moving the carriage, that each of the rod and means for mounting the rod comprise a control switch, each control switch having a normally open first switch member that is moved to a closed position by the rod moving from its datum position to its second position, that there is provided a motor for driving said driven means, power lines, a normally closed flap down safety switch, said motor and safety switch being connected in series across said power lines, said first switch members being connected in parallel with the safety switch and in series with one another across the power line the safety switch is connected to and the connection between the motor and safety switch, and means for moving the safety switch to an open condition during an interval of time said first switch members are supposed to be closed whereby the motor is deenergized in the event at least one of the first switch members is open during the time the safety switch is open.

10. The apparatus of claim 9 further characterized in that the gripper means includes a vacuum source and means, including a solenoid operated valve, for connecting the vacuum source to the cup means, that each of the control switches includes a normally closed second switch member that is moved to an open position by the rod moving from its datum position to its second position, one each of the second switch members and valves being connected in series across the power lines and each of the other of the second switch members and valves being connected in series across the power lines, each of said valves being of a construction to discontinue the application of vacuum to the respective cup means when the second switch member it is connected to is moved to an open position.

11. For removing a case having a body and flaps extending transversely outwardly from opposite sides of the body and joined thereto along fold lines from a vertical stack of cases in horizontal, flat folded conditions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slid from beneath the stack along the slide means, and stripper means mounted on the frame for moving the lowermost case along the slide means from beneath the stack after the lowermost flaps have been bent downwardly, said bending and retaining means including operable means on each transverse side of the slide means for grippingly engaging the adjacent flap when it is in a generally horizontal position, bending the gripped flap to the preselected angle and then releasing the gripped flap, means on the frame for moving the gripping means between a gripping position and a position more remote from the gripping position than the release position, and means mounted on the frame for retaining the adjacent bent flap at the preselected angle while permitting it moving longitudinally forwardly relative thereto and operating the respective gripping means to its releasing condition upon said adjacent bent flap being moved to its preselected angle, the last mentioned retaining means including on each transverse side of the slide means, a spring finger having a lower edge and means for dependingly mounting the finger in a datum position in the path of movement of the adjacent flap to its preselected angle to be moved thereby out of the path of movement until said adjacent flap extends below the spring finger and then permit the spring finger to move into overlapping relationship to said adjacent flap to hold it down.

12. The apparatus of claim 11 further characterized in that the last mentioned retaining means includes on each transverse side of the slide means, switch means mounted adjacent the spring finger on the same transverse side of the slide means for operating the respective gripping means to its release condition, each switch means including a switch member operated by the respective flap moving to its preselected angle, and means mounting the switch member for limited movement and in a position to coact with the adjacent spring finger to hold the respective flap at its preselected angle.

13. The apparatus of claim 1 further characterized in that the abutting means comprises means for abuttingly engaging the bent flaps, and that the means for moving the stripper means comprises means for reciprocating the stripper means.

14. For removing a case having a body and flaps extending transversely outwardly from opposite sides of the body and joined thereto along fold lines from a vertical stack of cases in horizontal, flat folded conditions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slid from beneath the stack along the slide means, the bending and retaining means including operable means on each transverse side of the slide means for grippingly engaging the adjacent flap when it is in a generally horizontal position, bending the gripped flap to the preselected angle and then releasing the gripped flap, means on the frame for moving the gripping means between a gripping position and a position more remote from the gripping position than the release position, and means mounted on the frame for retaining the adjacent bent flap at the preselected angle while permitting its moving longitudinally forwardly relative thereto and operating the respective gripping means to its releasing condition upon said adjacent bent flap being moved to its preselected angle, a motor, and stripper means mounted on the frame for moving the lowermost case along the slide means from beneath the stack after the lowermost flaps have been bent downwardly, the stripper means including a carriage, means on the carriage for moving the lowermost case from the bottom of the stack when the carriage is moving in one direction and means for drivably connecting the motor to the carriage for reciprocally moving the carriage, the means on the carriage including on either transverse side of the slide means, upper and lower gripper lugs and means mounting the lugs to extend above and below the respective flap at its preselected angle and means mounting the upper and lower lugs on the carriage to extend into overlapping and underlapping relationship respectively to the adjacent flap at its preselected angle and at a lower elevation than the uppermost part of the slide means.

15. For removing a case having a body and flaps extending transversely outwardly from opposite sides of the body and joined thereto along fold lines from a vertical stack of cases in horizontal, flat folded conditions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slid from beneath the stack along the slide means, the bending and retaining means including operable means on each transverse side of the slide means for grippingly engaging the adjacent flap when it is in a generally horizontal position, bending the gripped flap to the preselected angle and then releasing the gripped flap, means on the frame for moving the gripping means between a gripping position and a position more remote from the gripping position than the release position, and means mounted on the frame for retaining the adjacent bent flap at the preselected angle while permitting it moving longitudinally forwardly relative thereto and operating the respective gripping means to its releasing condition upon said adjacent bent flap being moved to its preselected angle, a motor, and stripper means mounted on the frame for moving the lowermost case along the slide means from beneath the stack after the lowermost flaps have been bent downwardly, the stripper means including a carriage, means on the carriage for moving the lowermost case from the bottom of the stack when the carriage is moving in one direction, means for drivably connecting the motor to the carriage for reciprocally moving the carriage, and control means for the motor to deactivate the motor in the event that at least one of the flaps is at an angle other than the preselected angle after the gripper means has been moved past its flap release position and prior to the carriage being moved in said one direction.

16. For removing a case having a body and flaps extending transversely outwardly from opposite sides of the body and joined thereto along fold lines from a vertical stack of cases in horizontal, flat folded conditions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slid from beneath the stack along the slide means, the bending and retaining means including operable means on each transverse side of the slide means for grippingly engaging the adjacent flap when it is in a generally horizontal position, bending the gripped flap to the preselected angle and then releasing the gripped flap, means on the frame for moving the gripping means between a gripping position and a position more remote from the gripping position than the release position, and means mounted on the frame for retaining the adjacent bent flap at the preselected angle while permitting the bent flap to move longitudinally forwardly relative thereto, and operating the respective gripping means to its releasing condition upon said adjacent bent flap being moved to its preselected angle, a motor, and stripper means mounted on the frame for moving the lowermost case along the slide means from beneath the stack after the lowermost flaps have been bent downwardly, the stripper means including a carriage, means on the carriage for moving the lowermost case from the bottom of the stack when the carriage is moving in one direction and means for drivably connecting the motor to the carriage for reciprocally moving the carriage, said gripper means including on each transverse side of the slide means, vacuum cup means for grippingly engaging the adjacent flap, and means mounted on the frame for moving the vacuum cup means between a datum lowered position and an elevated position where the cup means is engageable with the last mentioned flap when it is extending generally horizontally outwardly from the body, said gripper means also including a vacuum source and means, including an operable control valve, for connecting the vacuum source to each of the cup means, and said operating and retaining means including on each transverse side of the slide means, switch means operated by the adjacent flap being moved to its preselected angle for operating the control valve for the cup means on the same transverse side of the slide means to discontinue the application of vacuum to the last mentioned cup means whereby the gripped flap is released.

17. For removing a case having a body and flaps extending transversely outwardly from opposite sides of the body and joined thereto along fold lines from a vertical stack of cases in horizontal, flat folded conditions, a frame, longitudinally elongated slide means on the frame for supporting the stack of cases at the bodies thereof, means mounted on the frame for retaining the cases in the stack in generally vertical alignment while permitting the lowermost case of the stack to be slid longitudinally forwardly along the slide means from beneath the stack, means mounted on the frame for bending the lower transversely opposite flaps of the lowermost case in the stack downwardly at a preselected angle on each side of the body relative the body and retaining the bent down flaps in the bent condition while permitting the lowermost case to be slid from beneath the stack along the slide means, the bending and retaining means including operable means on each transverse side of the slide means for grippingly engaging the adjacent flap when it is in a generally horizontal position, bending the gripped flap to the preselected angle and then releasing the gripped flap, means on the frame for moving the gripping means between a gripping position and a position more remote from the gripping position than the release position, and means mounted on the frame for abutting against the adjacent bent flap to retain the flap at the preselected angle prior to the gripping means releasing the gripper flap while permitting the flap to be moved longitudinally forwardly relative thereto, and operating the respective gripping means to its releasing condition upon said adjacent bent flap being moved to its preselected angle and prior to the lowermost case being moved forwardly relative the stack by the stripper means.

18. The apparatus of claim 17 wherein the bent flaps have rear edge portion, further characterized in that the stripper means comprises means for abuttingly engaging the bent flaps rear edge portions to move the lowermost case in the stack forwardly.

* * * * *